US008795101B2

(12) United States Patent
Nishio

(10) Patent No.: US 8,795,101 B2
(45) Date of Patent: Aug. 5, 2014

(54) GOLF CLUB HEAD AND GOLF CLUB USING THE SAME

(75) Inventor: Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 219 days.

(21) Appl. No.: 13/409,779

(22) Filed: Mar. 1, 2012

(65) Prior Publication Data

US 2012/0225734 A1 Sep. 6, 2012

(30) Foreign Application Priority Data

Mar. 2, 2011 (JP) ..... 2011-045462

(51) Int. Cl.
*A63B 53/08* (2006.01)

(52) U.S. Cl.
USPC ..... 473/345; 473/349; 473/332

(58) Field of Classification Search
USPC ..... 473/345, 349, 332
See application file for complete search history.

(56) References Cited

U.S. PATENT DOCUMENTS

| | | | | |
|---|---|---|---|---|
| 7,128,664 | B2 * | 10/2006 | Onoda et al. | 473/347 |
| 2005/0159243 | A1 * | 7/2005 | Chuang | 473/345 |
| 2005/0272527 | A1 * | 12/2005 | Sugimoto | 473/345 |
| 2006/0019768 | A1 * | 1/2006 | Lo | 473/345 |
| 2008/0242445 | A1 * | 10/2008 | Mergy et al. | 473/345 |

FOREIGN PATENT DOCUMENTS

| | | | |
|---|---|---|---|
| JP | 2003-199848 | A | 7/2003 |
| JP | 2006-006975 | A | 1/2006 |

* cited by examiner

*Primary Examiner* — Benjamin Layno
(74) *Attorney, Agent, or Firm* — Birch, Stewart, Kolasch & Birch, LLP

(57) ABSTRACT

A golf club head provided with a hollow includes a head main portion made of metal material with an opening, a cover member made of fiber reinforced resin and covering the opening, wherein the opening includes a crown opening region provided in a crown portion and a sole-side opening region provided in the sole and side portions, and the crown opening region has an opening area projected onto an outer surface of the club head in a range of from 63 to 77% of a superficial area of the crown portion. The sole-side opening region has an opening area projected onto the outer surface of the club head being in a range of from 4 to 25% of the superficial area of the sole portion and the side portion in sum total.

8 Claims, 10 Drawing Sheets

(a)

(b)

E1 Cross section

GOLF CLUB HEAD AND GOLF CLUB USING THE SAME

BACKGROUND OF THE INVENTION

1. Field of the Invention

The present invention relates to a golf club head having excellent hitting sound and improved directional stability of a hit ball, and a golf club using the golf club head.

2. Description of the Background Art

In recent years, it has been known an attempt to lower the center of gravity of the golf club head to improve flight distance of a hit golf ball. Such a golf club head comprises a fiber reinforced resin member, whose specific gravity is smaller than a metal material such as a titanium alloy and the like, for example, in a crown portion and/or a sole portion. However, in such a combined type of a golf club head, the moment of inertia Ic (shown in FIG. 2) about an axial center line CL of a club shaft (such moment of inertia may be hereinafter simply referred to as "moment of inertia") tends to be small, depending on a position where the fiber reinforced resin is provided. For such a golf club head with the small moment of inertia Ic, there was a problem that orientation of a club face was not stable during swinging, and thus directional stability of a hit golf ball easily degraded.

For such a golf club head, there was also a problem that hitting sound became significantly low depending on a position where the fiber reinforced resin was provided, thereby degrading impact feeling.

The inventor, et. al conducted various experiments on the problems described above. As a result, when the club head is viewed from the sole side while the head being in a standard state in which the head is disposed on a horizontal plane so that a center line of a club shaft is inclined at the lie angle within a vertical plane and a club face forms its loft angle with respect to the vertical plane, it was revealed that the center of gravity of the head in the sole portion is a location subject to large vibration at the impact of the ball. Then, it was learned that provision of fiber reinforced resin in any location other than a location subject to large vibration is effective in improvement of the impact feeling.

SUMMARY OF THE INVENTION

The present invention has been made in light of the circumstances described above, and a principal object of the present invention is to provide a golf club head having excellent hitting sound and improved flight distance or directional stability of a hit ball, by defining a location to provide a cover member, in a golf club head including a head main portion made of a metal material and the cover member made of a fiber reinforced resin.

According to the present invention, a golf club head provided with a hollow comprising a head main portion made of metal material and having at least one opening, a cover member made of fiber reinforced resin and covering the opening, the opening comprising a crown opening region provided in a crown portion and a sole-side opening region provided in a sole portion and a side portion, the crown opening region having an opening area projected onto an outer surface of the club head being in a range of from 63 to 77% of a superficial area of the crown portion, the sole-side opening region having an opening area projected onto the outer surface of the club head being in a range of from 4 to 25% of the superficial area of the sole portion and the side portion in sum total, wherein in a standard state in which the head is disposed on a horizontal plane so that a center line of a club shaft is inclined at the lie angle within a vertical plane and a club face forms its loft angle with respect to the vertical plane, a bottom view of the head has a face-heel region and a back face-heel region, the face-heel region is a region which is located in front and heel side when the bottom view of the head is divided as four regions by the first straight line parallel with the center line of the club shaft and passing through a center of gravity of the head, and the second straight line being at right angle to the first straight line and passing through a center of gravity of the head, the back face-heel region is a region which is located in back and heel side area of the four regions, and the sole-side opening region is disposed in the face-heel region and/or the back face-heel region.

Such a golf club head improves flight distance of a hit golf ball as the cover member lowers the center of gravity. In addition, in the golf club head of the present invention, since the cover member made of a fiber reinforced resin is provided in a position away from the head center of gravity in the bottom view of the head, the club head easily vibrates and produces higher pitched hitting sound and improved impact feeling, when a golf ball is hit.

DESCRIPTION OF THE PREFERRED EMBODIMENTS

One embodiment of the present invention will be described hereinafter with reference to the drawings.

Figure 1:
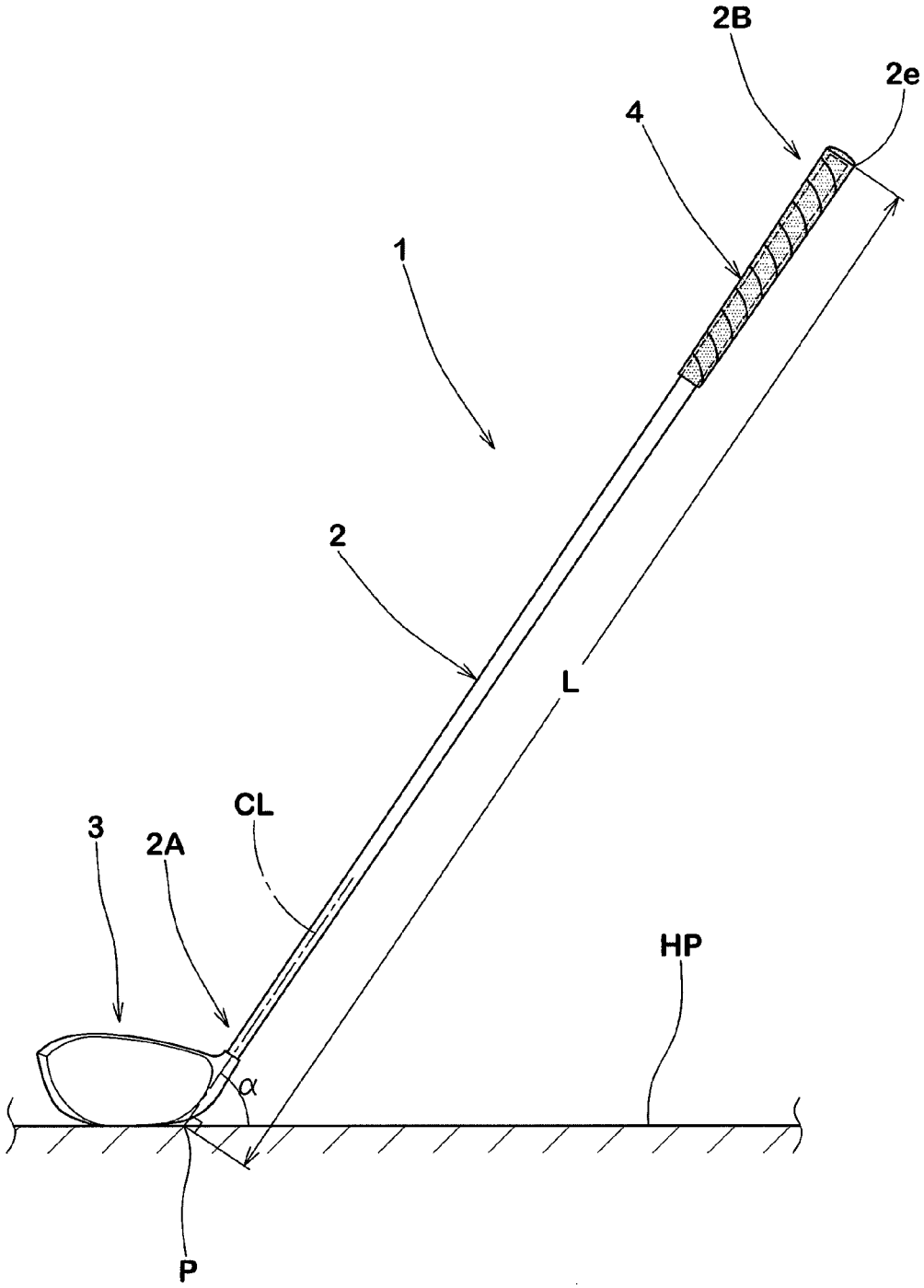
FIG. 1 is a front view of a standard state of a golf club according to one embodiment of the preset invention.
Figure 2:
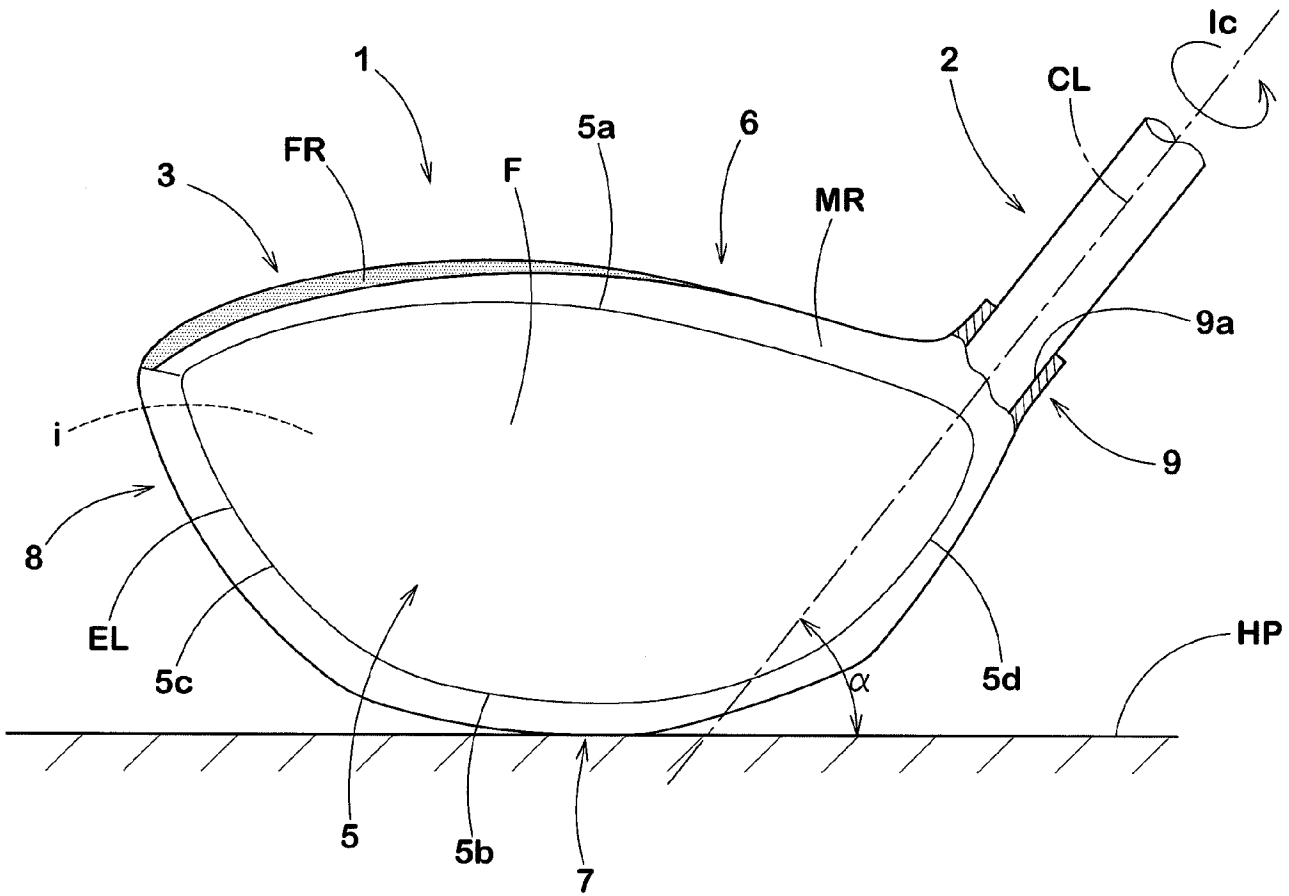
FIG. 2 is a partially enlarged view thereof.

As shown in FIG. 1, a golf club (which may be hereinafter simply referred to as a "club") 1 of the embodiment is configured to include a club shaft 2, a golf club head (which may be hereinafter simply referred to as a "head") 3 firmly fixed to a front end side 2A of the club shaft 2, and a grip 4 provided at a back end side 2B of the shaft 2 and to be held by a player. In addition, the head 3 of the embodiment is configured as Driver (#1) or a wood type golf club head such as a fairway wood. Specifically, the head includes the Driver (#1), Brassy (#2), Spoon (#3), Baffy (#4), and Creek (#5) and the like, and also includes a club which differs from those listed in the count number or a name but has a similar shape.

Figure 3:
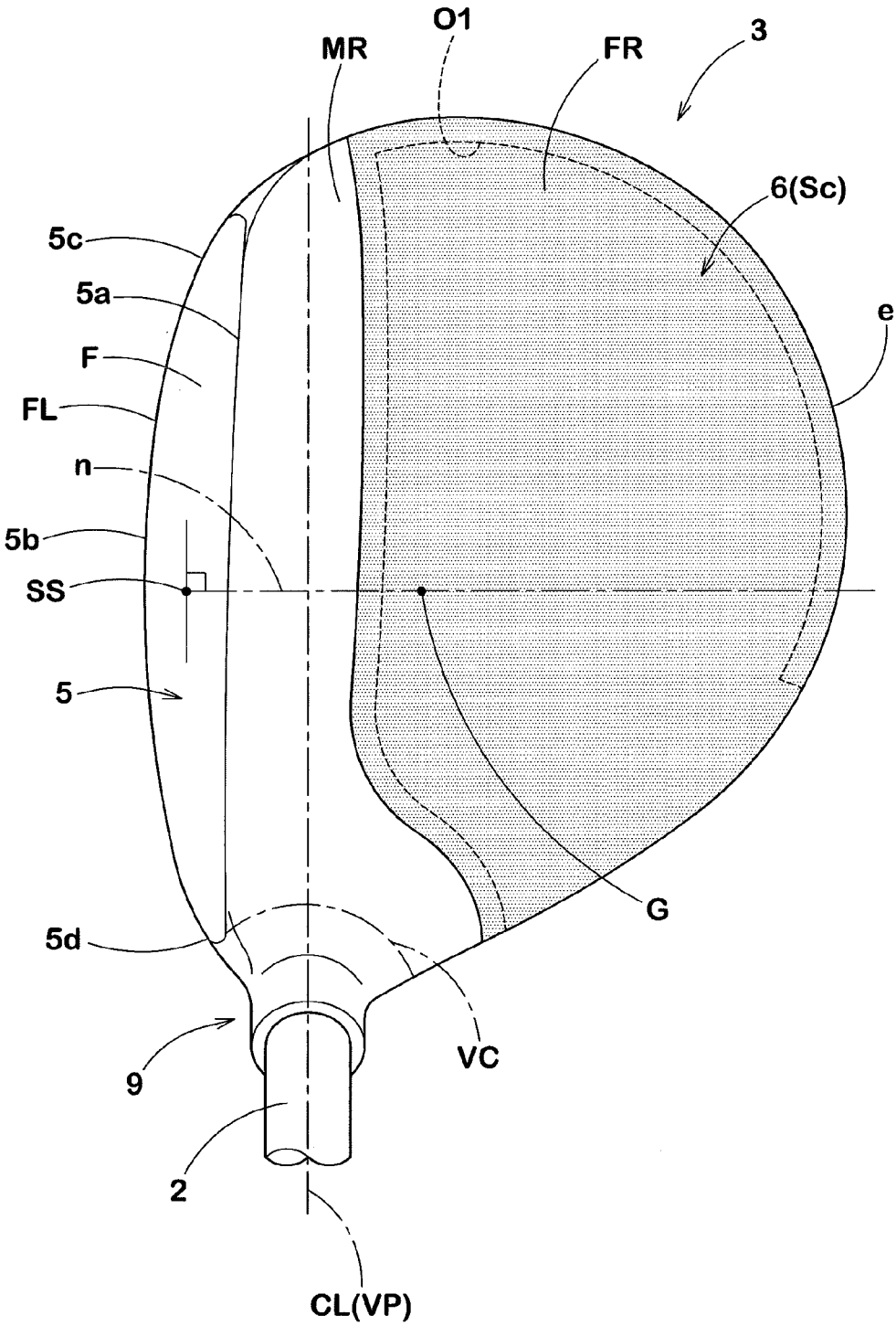
FIG. 3 is a plan view of FIG. 2.
Figure 4:
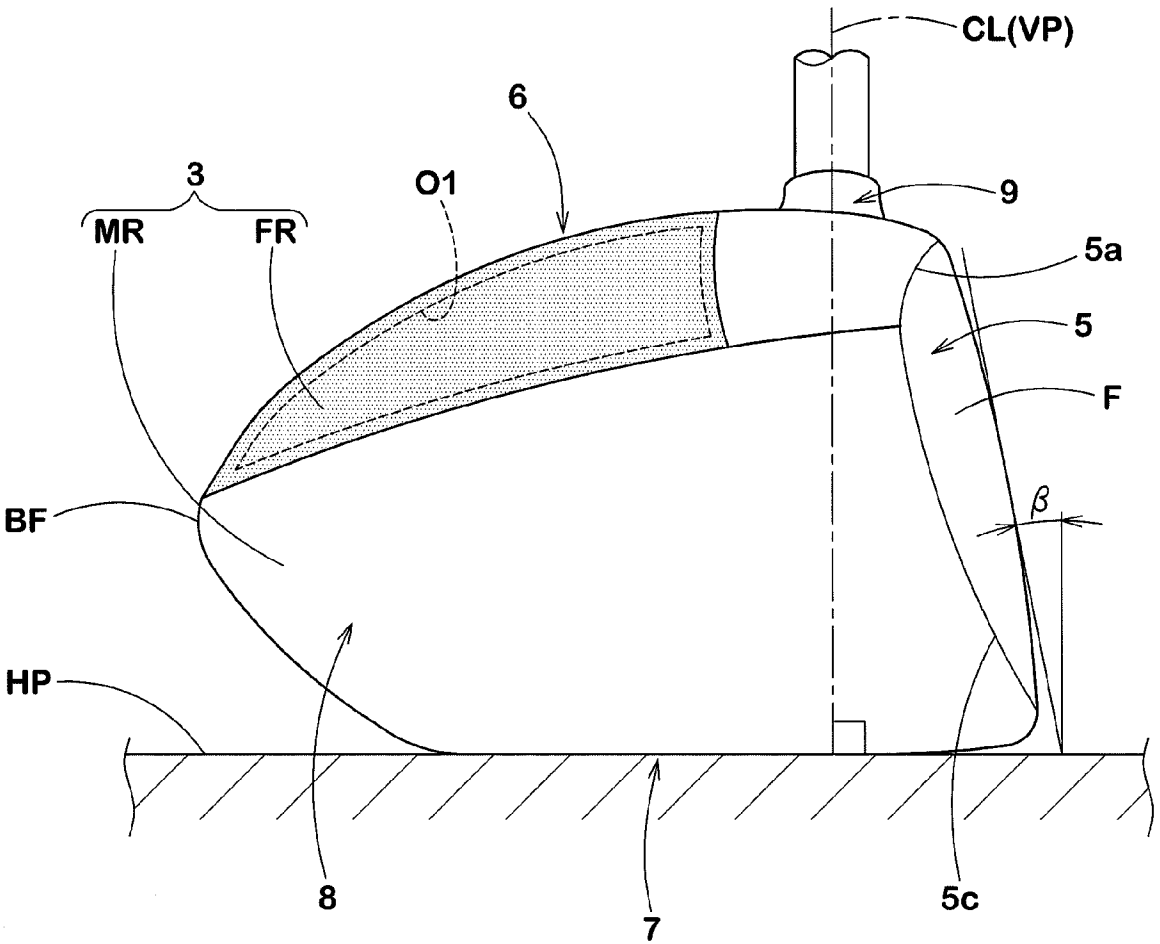
FIG. 4 is a side elevational view of FIG. 2 when viewed from the toe side.

In addition, the golf club 1 in FIGS. 1 to 5 is placed in a standard state. The standard state is a state in which the golf club is disposed on a horizontal plane HP so that an axial center line CL of the shaft is arranged within any vertical plane VP and inclined at a defined lie angle $\alpha$ to the vertical plane VP and a sweet spot SS of a face F forms a loft angle β (a face angle is set to zero) with respect to the horizontal plane HP. Note that in the specification, unless otherwise noted, a description will be given on the assumption that the golf club 1 is in such a standard state. In addition, a loft angle is given as an angle larger than 0 degree. In addition, as shown in FIG. 3, the sweet spot SS is a point where a normal n extending from the center of gravity G of the head to the face F intersects with the face F.

Although no specific limitation is set on club length L of the golf club 1, it is preferably set not less than 39.5 inches and more preferably not less than 40 inches, and preferably set not more than 47 inches and more preferably not more than 46 inches. If the club length L is small, it cannot be adequately expected that head speed is improved by utilizing length of a club and flight distance of a hit ball is increased. In contrast, if the club length L is large, not only hitting points fluctuate but also a golfer has uneasy feeling because he/she feels that the club is long when he/she holds it.

Here, the club length L is length measured along the axial center line CL of the club shaft 2 from the back end 2*e* of the shaft 2 to an intersection P of the horizontal plane HP and the axial center line CL of the shaft, in the standard state shown in FIG. 1.

As shown in FIGS. 2 to 5, the head 3 is provided with a face portion 5 with a face F which forms a hitting surface to hit a ball, a crown portion 6 which is connected to an upper edge 5*a* of the face F and forms a top surface of the head, a sole portion 7 which is connected to a lower edge 5*b* of the face and forms a bottom surface of the head, a side portion 8 which connects between the crown portion 6 and the sole portion 7 and extends from a toe-side edge 5*c* to a heel-side edge 5*d* of the face F through a back face BF, and a hosel 9 provided on the heel side of the crown portion 6 and having a cylindrically shaped shaft insertion hole 9*a* into which the end of the shaft 2 is inserted. In addition, a hollow i (shown in FIG. 6) is provided inside the head 3.

Although no specific limitation is set on a volume V of the head 3, it is preferably set not less than 70 $cm^3$ and more preferably not less than 90 $cm^3$, and preferably set not more than 500 $cm^3$ and more preferably not more than 220 $cm^3$. If the volume of the head 3 is small, the moment of inertia Ic of the head 3 tends to be small, and head shift at mishit becomes large, and thus directionality of a hit ball tends to degrade. On the other hand, if the volume of the head 3 is large, weight of the club increases and may lead to deteriorations of swing balance or deceleration of head speed and the like.

In addition, if mass of the head 3 is too small, there is the tendency that kinetic energy of the head decreases, and thus improvement of flight distance cannot be expected. In contrast, if the mass is too large, there is the tendency that taking a full swing becomes difficult and directional stability or flight distance of a hit ball degrades. From such a standpoint, the mass of the head 3 is preferably set not less than 180 g and more preferably not less than 185 g, and preferably set not more than 240 g and more preferably not more than 235 g.

Figure 6:
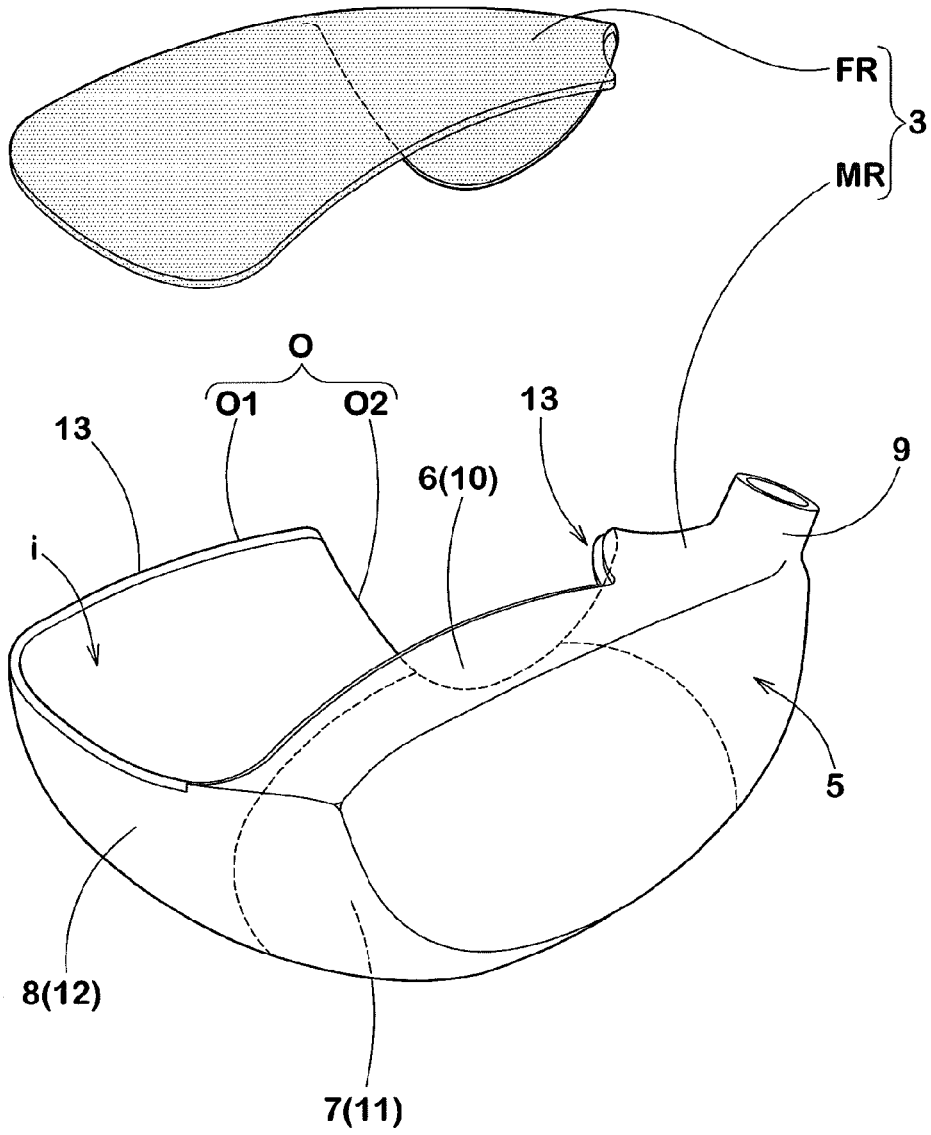
FIG. 6 is an exploded perspective view of a golf club head of the embodiment.
Figure 7:
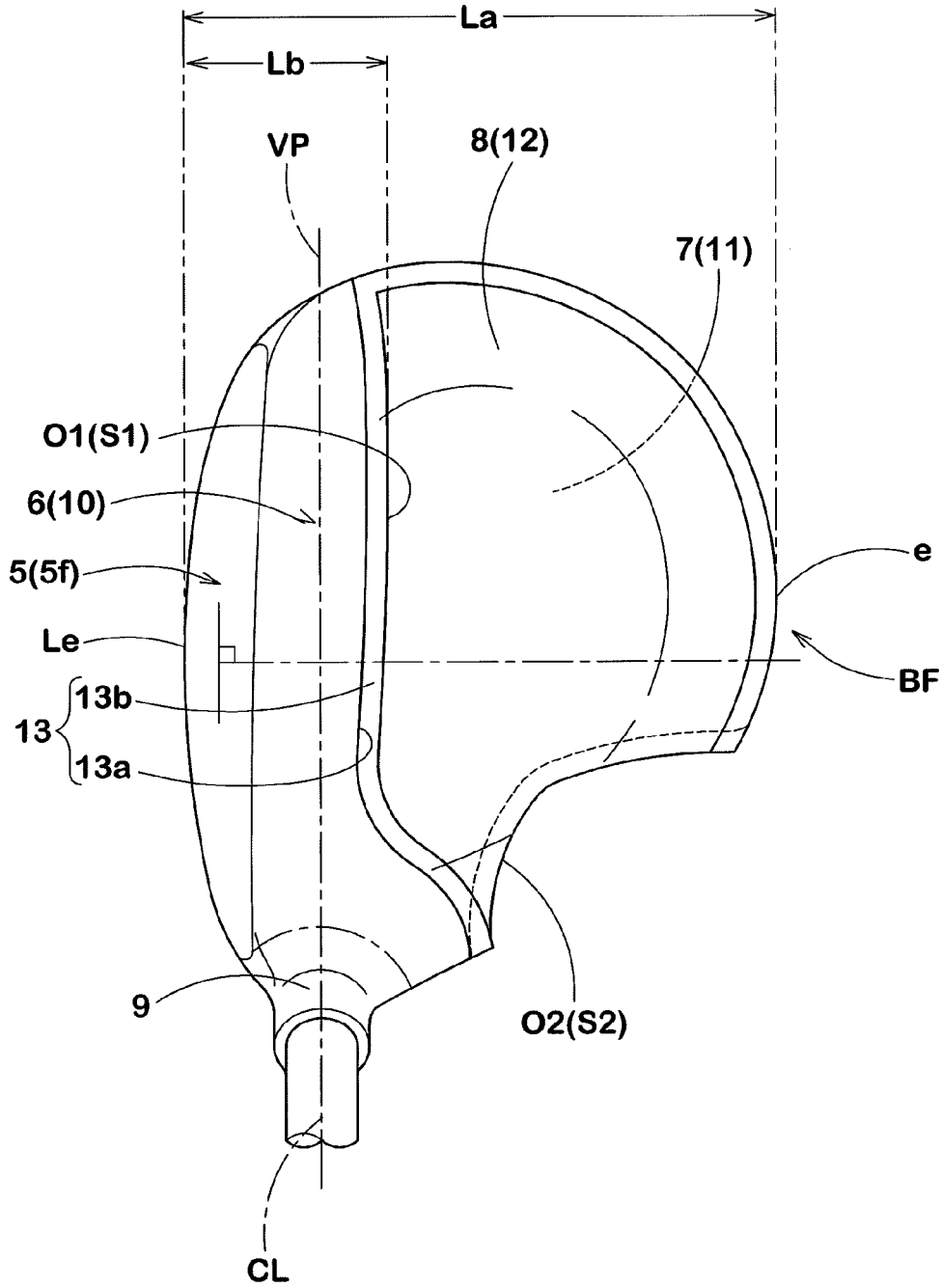
FIG. 7 is a plan view of a head main portion.

In addition, as shown in FIGS. 6 to 7, the head 3 is configured to include a head main portion MR made of a metal material with at least one (one in the embodiment) opening O and a cover member FR made of fiber reinforced resin and covering the opening O. Note that the opening O does not include the shaft insertion hole 9*a*.

It is desirable that the head main portion MR of the embodiment is composed of a metal material with excellent specific intensity. Although no specific limitation is set, one kind or two or more kinds of metal materials such as a titanium alloy or stainless and the like, for example, may be used. Then, in order to ensure a volume V necessary for the head 3 while securing rigidity of the head main portion MR, the specific gravity ρ1 of a metal material of the head main portion MR is preferably not less than 3.0 and more preferably not less than 3.5, and preferably not more than 8.5 and more preferably not more than 8.0.

In addition, the head main portion MR is configured to include a face portion 5, a crown main wall portion 10 which forms a part of the crown portion 6 excluding the opening O, a sole main wall portion 11 which forms a part of the sole portion 7 excluding the opening O, a side main wall portion 12 which forms a part of the side portion 8 excluding the opening O, and a hosel 9. The head main portion MR of the embodiment is configured so that each of the portions is integrally formed by casting. However, the head main portion MR may be formed by molding two or more parts by forging, casting, pressing or rolling and the like and then integrally bonding them by welding and the like.

In the embodiment, the cover member FR is formed by almost plate shaped material which has small thickness and is bent to have a smoothly curved surface.

In addition, a fiber reinforced resin composing the cover member FR is a composite material of fibers as a reinforcing material and matrix resin, and has a smaller specific gravity than a metal material. Thus, the head 3 of the present invention has lighter weight, coupled with the opening O provided in the head main portion MR. From such a standpoint, the specific gravity ρ2 of the cover member FR is preferably not more than 3.0 and more preferably not more than 2.5. In addition, if the specific gravity ρ2 is smaller, strength of the cover member FR may degrade. Thus, the specific gravity ρ2 is preferably not less than 0.7 and more preferably not less than 0.9.

The matrix resin is preferably an epoxy resin, an unsaturated polyester resin and the like, for example. The fiber is an organic fiber such as a carbon fiber or a glass fiber or a meal fiber such as an amorphous fiber and the like, for example. Although no specific limitation is set on the tensile modulus of elasticity of the fiber, it is preferably not less than 50 GPa and more preferably not less than 100 GPa, and preferably not more than 450 GPa and more preferably not less than 350 GPa, from the standpoint of controlling rising costs while ensuring durability of the cover member FR. The tensile modulus of elasticity shall be a value measured in accordance with JISR7601 "Carbon Fiber Testing Method". Here, when two or more kinds of fibers are involved, as shown by the following expression (1), it shall be average elastic modulus by weighting the elastic modulus of each fiber by its mass ratio.

$$\text{Average elastic modulus}=\Sigma(Ei\cdot Vi)/\Sigma Vi(i=1,2\ldots)$$

(where "Ei" is the elastic modulus of the fiber and "Vi" is total mass of the fibers.)

As shown in FIG. 6 and FIG. 7, in the head main portion MR, around the opening O is provided an opening edge portion 13 with a step-like shaped cross section and including a stepped surface 13*a* which is formed by the outer surface of the head denting from the crown main wall portion 10, the sole main wall portion 11, and the side main wall portion 12 to the hollow side, and a receiving surface 13*b* which extends on the center side of the opening O from the inner end of the stepped surface 13*a* and supports the periphery of an inner surface FRi of the cover member FR. In the embodiment, the opening edge portion 13 is annularly and continuously provided. In addition, the opening edge portion 13 and the cover member FR are firmly fixed by various bonding methods such as adhesive, or swaging a part of which is plastically deformed, and the like, for example.

Figure 8:
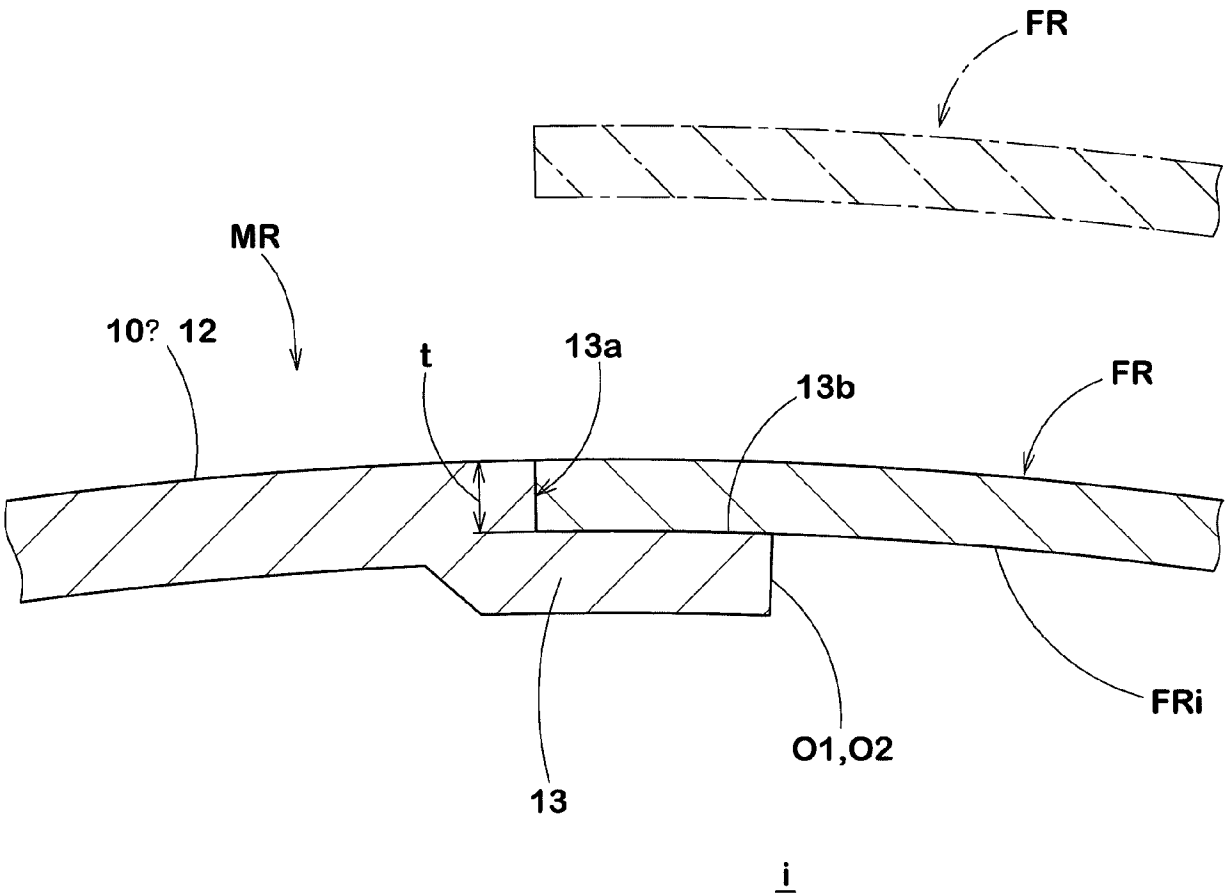
FIG. 8 is an enlarged cross sectional view illustrating an opening periphery.

As shown in FIG. 8, the head main portion MR and the cover member FR can be finished to be flush by making the stepped surface 13*a* of the opening edge portion 13 have thickness t appropriate to thickness of the cover member FR.

In the head 3 in finished state, the opening O is configured to include a crown opening region O1 provided on the crown portion 6 and a sole-side opening region O2 provided on the sole portion 7 and the side portion 8. The head 3 provided with such an opening O can reduce usage of metal materials and contributes to lowering of the center of gravity of the head and increasing of the moment of inertia Ic.

The crown opening region O1 has an opening area S1 which is projected onto the outer surface of the head being in the range of from 63 to 77% of a superficial area Sc of the crown portion 6. If the opening area S1 is below 63% of the superficial area Sc of the crown portion 6, the center of gravity of the head cannot be lowered by reducing the mass of the head upper portion. In contrast, if the opening area S1 is larger than 77% of the superficial area Sc, rigidity of the crown main wall portion 10 excessively decreases, and degrades durability of the head 3. From such a standpoint, the opening area S1 is more preferably 66% or wider than the superficial area Sc of the crown portion 6, and more preferably 74% or narrower.

Here, as shown in FIG. 3, when the head 3 in finished state is viewed from the top plane in standard state, the superficial area Sc of the crown portion 6 is a superficial area of a part surrounded by the upper edge 5*a* of the face F, a side edge e most protruded to the head lateral side, and a virtual curved line VC formed by a virtual cylinder which has the axial center line CL of the shaft insertion hole 9*a* as a center axis and has radius of 20 mm intersecting the outer surface of the head.

In addition, although no specific limitation is set on the superficial area Sc of the crown portion 6, it is preferably 40 $cm^2$ or wider and more preferably 50 $cm^2$ or wider, and preferably 200 $cm^2$ or narrower and more preferably 190 $cm^2$ or narrower to balance lighter weight and feeling of safety at the time of addressing.

As shown in FIG. 7, the crown opening region O1 of the embodiment is spaced from the upper edge 5*a* of the face portion 5 and provided on the back face BF side. With this, the cover member FR with a high vibration-damping effect and tending to reduce hitting sound is provided at a position away from the face F, the high-pitched hitting sound can be maintained and the impact feeling can be improved. On the other hand, if the crown opening region O1 is too far from the upper edge 5*a* of the face portion 5, the opening O becomes small, which may prevent lowering of the center of gravity of the head 3. From such a standpoint, a ratio of the shortest distance Lb in the front-back direction of the head from the leading edge Le to the crown opening region O1 to head length La, which is maximum length in a front-back direction of the head from a leading edge Le (position closest to the front side in the standard state) of the head 3 to the head rear, is preferably not less than 20% and more preferably not less than 25%, and preferably not more than 45% and more preferably not more than 40%.

The sole-side opening region O2 has an opening area S2 which is projected onto the outer surface of the head being in a range of from 4 to 25% of a superficial area sg which is a sum total of the sole portion 7 and the side portion 8. If the opening area S2 is less than 4%, the effect of increasing the moment of inertia Ic described above cannot be obtained. In contrast, if the opening area S2 exceeds 25%, the center of gravity cannot be lowered. Furthermore, if the percentage of the cover member FR to the sole portion 6 increases, the hitting sound tends to fall and thus the impact feeling degrades. From such a standpoint, it is desirable that the opening area S2 is preferably not less than 6% and more preferably 20% or less than the superficial area Sg.

The superficial area Sg which is a sum total of the sole portion 7 and the side portion 8 is assumed to be an area obtained by subtracting, from a total superficial area 5 of the head 3 when the head main portion MR and the cover member FR are assembled, a superficial area on the hosel side part of the virtual curved line VC, the superficial area Sc of the crown portion 6, and an area Sf of the face F. In addition, the area Sf of the face F is a closed region enclosed by a face periphery EL including the upper edge 5*a*, the lower edge 5*b*, the toe-side edge 5*c*, and the heel-side edge 5*d* of the face F. If concave parts such as face grooves or punch marks (both not shown) and the like are provided on the face F, the area of the face F is measured in the condition in which all of the concave parts is filled.

Figure 9:
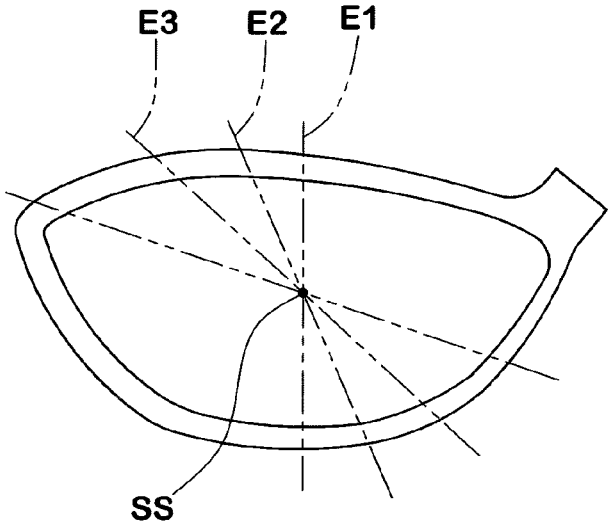
FIG. 9A is a front view of a club head illustrating a face.
FIG. 9B is a cross sectional view of FIG. 9A illustrating a face periphery.
Figure 9:
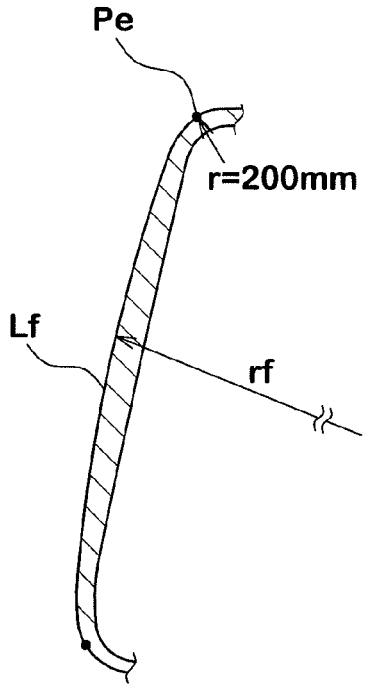

Furthermore, when the face periphery EL can be distinguished by an apparently clear edge line, it is defined as the edge line. However, if such an edge line is not clear, as shown in FIGS. 9A and 9B, the head 3 is cut by a number of planes E1, E2 . . . which connect the head center of gravity G with the sweet spot SS, and in each cross section, a position Pe, where each radius of curvature rf of a contour line Lf of the face F for the first time becomes 200 mm from the sweet spot SS side to the outer side, is defined as the face periphery EL at that position. Such a periphery can be determined by, for example, measuring planes E1, E2 . . . by the small angle (5 degrees, for example) and connecting them.

Figure 5:
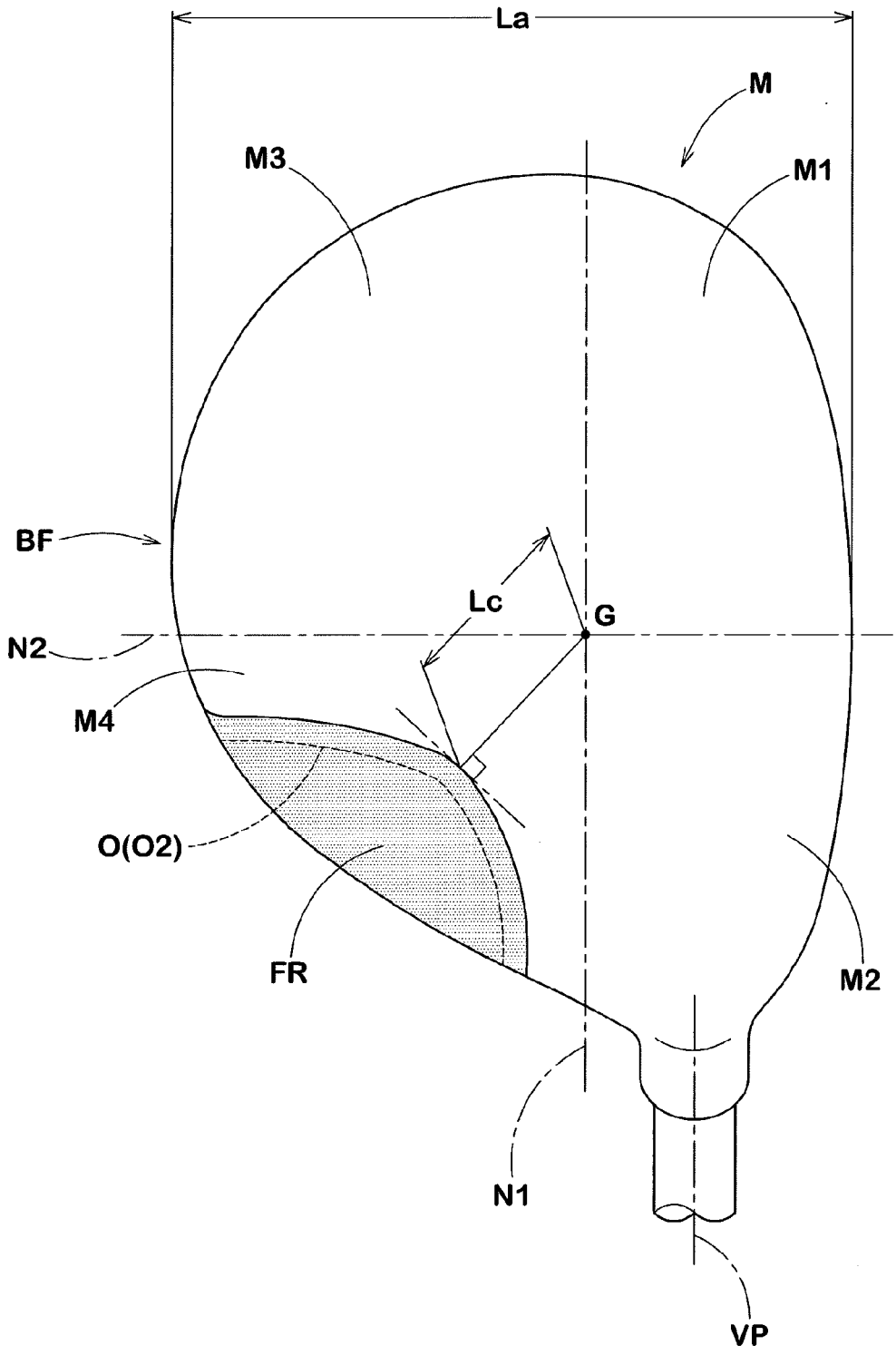
FIG. 5 is a bottom view of FIG. 2 when viewed from the sole side.

As shown in FIG. 5, a bottom view of the head 3 in the standard state is virtually divided by a first straight line N1 extending parallel with the axial center line CL of the shaft and passing through the center of gravity G of the head and a second straight line N2 passing through the center of gravity G of the head and extending at the right angle to the first straight line N1 into a face-toe region M1 formed on the face side and the toe side, a face-heel region M2 formed on the face side and the heel side, a back face-toe region M3 formed on the back face side and the toe side, and a back face-heel region M4 formed on the back face side and the heel side, the sole-side opening region O2 of the present invention is provided in the face-feel region M2 and/or the back face-heel region M4. In such a head 3, as the cover member FR made of a fiber reinforced resin with small specific gravity is arranged in the vicinity of the axial center line CL, and most of the head main portion MR which is made of a metal material with large specific gravity is arranged away from the axial center line, the moment of inertia Ic becomes large. Therefore, orientation of the face is stable during swinging and directional stability of a hit ball improves.

It is desirable that in order to maintain high-pitched ball hitting sound, the sole-side opening region O2 is provided only in the back face-heel region M4 which is far from the face F to hit a ball, as with the embodiment.

In addition, the opening O of the embodiment is formed as a single opening in which the crown opening region O1 and the sole-side opening region O2 are connected on the back face side and the heel side. Thus, not only the head 3 formed as one opening can further reduce the head mass but also the head main portion MR can be easily molded. In addition, as the cover member FR and the head main portion MR can be firmly fixed at one time, the production efficiency improves.

Moreover, in the bottom view M, the shortest distance Lc between the position of the center of gravity G of the head and the cover member FR is preferably 20% or longer and more preferably 25% or longer, and preferably 45% or shorter and more preferably 40% or shorter of the head length La. If the shortest distance Lc increases, the opening O becomes small. Thus, the moment of inertia Ic may not be increased. In contrast, if the shortest distance Lc decreases, the cover member which is made of fiber reinforced resin tends to be provided near the center of gravity of the head in the bottom view of the head. Therefore, hitting sound may become lower and impact feeling may degrade.

Although the present invention has been described in detail above, the present invention is not limited to the specific embodiments described above and can be modified to various modes, as needed. For example, the opening O may be divided to two openings in the crown portion 6 and the side-sole portion.

Comparative Test:

In order to confirm advantageous effects of the present invention, wood-type golf club heads based on the crown portion as shown in FIG. 3 and specifications of Table 1 were prototyped, and tests were conducted on directional stability of a hit ball, moment of inertia Ic, impact feeling and height of center of gravity of the head. Each head main portion is an integrally cast item of a titanium alloy (Ti-6Al-4V). All parameters other than those shown in Table 1 are identical and main common specifications are as follows:

Lie angle α: 59 degrees
Loft angle β: 19.0 degrees
Head volume V: 155 $cm^3$
Club length L: 42 inches
Specific gravity of the head main portion ρ1: 4.5
Specific gravity of the cover member ρ2: 1.1
Average thickness of the face portion: 2.0 mm
A testing method is as follows.

Directional stability of a hit ball:

Each of thirty handicap 3 to 25 golfers hit 10 balls each of the commercially available 3-piece golf balls ("XXIO SUPER XD" manufactured by SRI sports Limited). The shortest distance from straight lines connecting a target and hit points to a ball stopped position (a measured value shall be a positive value irrespective of whether a ball deviates to the right or left relative to the target) were measured, and an average value of the 10 balls of each golfer was calculated. Then, an average value of another thirty golfers was determined and evaluated. The smaller the numeric value is, the better the directional stability is.

Moment of Inertia:

In the head standard state, the moment of inertia Ic around the axial center line CL of the shaft was measured by using MOMENT OF INERTIA MEASURING INSTRUMENT, MODEL NO. 005-002 manufactured by INERTIA DYNAMICS Inc. The larger the numeric values are, the less and the better the head shift is at the time of mishit.

Impact Feeling:

The above golfers hit on trial 5 of the above golf balls. In accordance with feeling of each golfer, preference of ball hitting sound was measured by the five-point method, and their average point was shown. The larger numeric value indicates that the ball hitting sound is more preferred by the golfers.

Height of the center of gravity:

In the above standard state, height of the center of gravity which is vertical height from the horizontal plane to the sweet spot SS was measured. The smaller, the better. Table 1 shows test results, and the like.

TABLE 1

Figure 10:
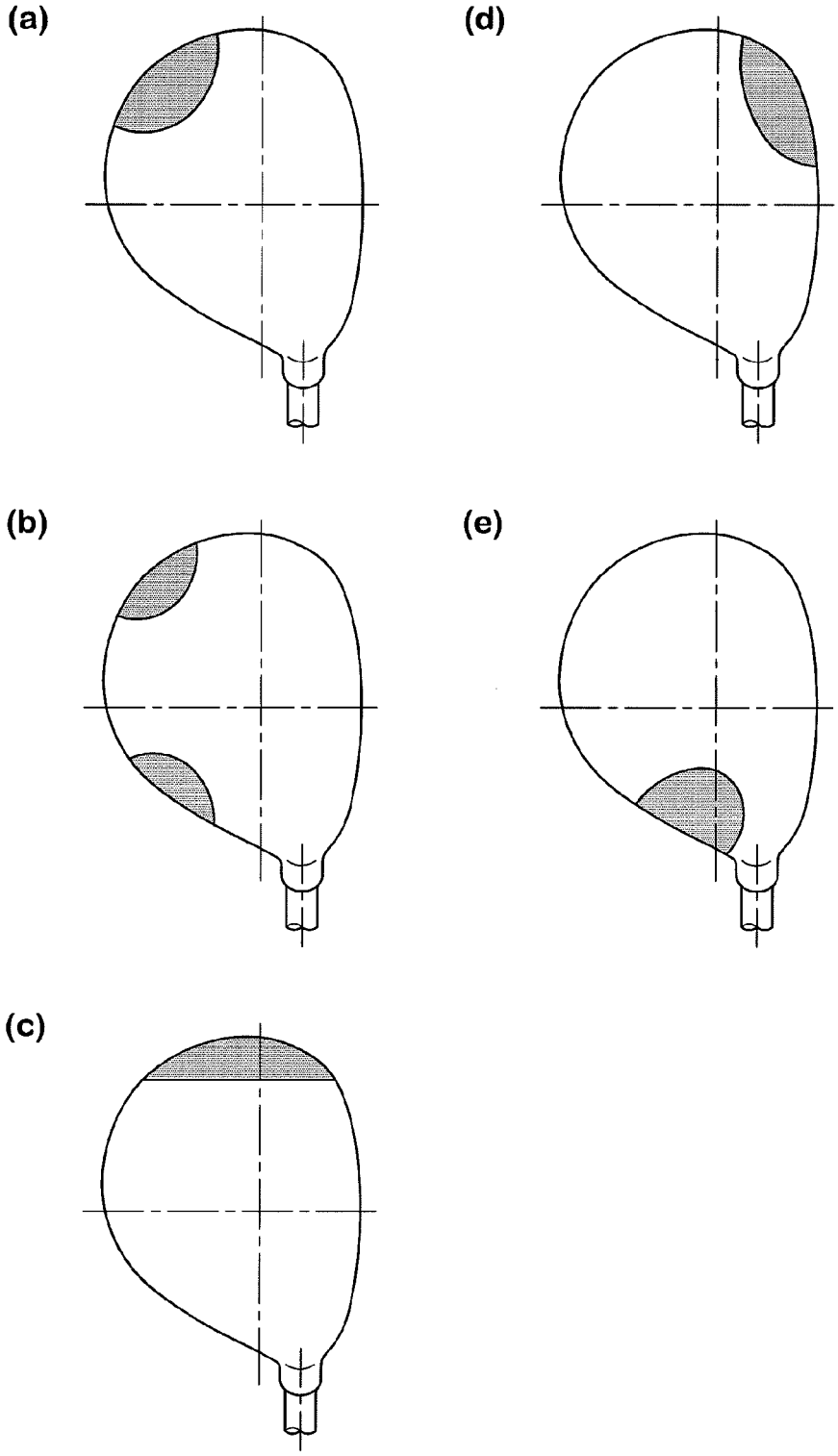
FIGS. 10A to 10D are views showing a bottom region viewed from the sole side of a comparative example.
FIG. 10E is a view showing a bottom region viewed from the sole side of other embodiment.

| | Comparative example 1 | Comparative example 2 | Comparative example 3 | Comparative example 4 | Example 1 | Comparative example 5 | Example 2 | Example 3 | Comparative example 6 |
|---|---|---|---|---|---|---|---|---|---|
| Figure showing bottom view of head | FIG. 10a | FIG. 10b | FIG. 10c | FIG. 10d | FIG. 5 | FIG. 5 | FIG. 5 | FIG. 5 | FIG. 5 |
| Opening area ratio of the crown opening region S1/Sc (%) | 70 | 70 | 70 | 70 | 70 | 60 | 64 | 76 | 80 |
| Opening area ratio of the sole-side opening region S2/Sg (%) | 10 | 10 | 10 | 10 | 10 | 10 | 10 | 10 | 10 |
| Shortest distance between head center of gravity and cover member Lc/La (%) | 32 | 32 | 32 | 32 | 32 | 32 | 32 | 32 | 32 |
| Moment of inertia Ic (g · $cm^2$) [larger value is better] | 4300 | 4255 | 4200 | 4400 | 4700 | 4550 | 4600 | 4800 | 5000 |
| Directional stability of hit ball (m) [smaller value is better] | 11.1 | 11.5 | 11.2 | 10.5 | 5.4 | 8.5 | 6.4 | 6.7 | 8.3 |
| Impact feeling [larger value is better] | 3.2 | 3.0 | 2.9 | 3.1 | 4.5 | 4.2 | 4.3 | 4.2 | 3.6 |
| Height of center of gravity (mm) [smaller value is better] | 22.0 | 21.9 | 21.9 | 22.1 | 21.0 | 21.3 | 21.2 | 20.8 | 20.6 |

| | Comparative example 7 | Example 4 | Example 5 | Comparative example 8 | Example 6 | Example 7 | Example 8 | Example 9 | Example 10 |
|---|---|---|---|---|---|---|---|---|---|
| Figure showing bottom view of head | FIG. 5 | FIG. 5 | FIG. 5 | FIG. 5 | FIG. 5 | FIG. 5 | FIG. 5 | FIG. 5 | FIG. 10e |
| Opening area ratio of the crown opening region S1/Sc (%) | 70 | 70 | 70 | 70 | 70 | 70 | 70 | 70 | 70 |
| Opening area ratio of the sole-side opening region S2/Sg (%) | 3 | 6 | 25 | 27 | 10 | 10 | 10 | 10 | 10 |

TABLE 1-continued

| | | | | | | | | | |
|---|---|---|---|---|---|---|---|---|---|
| Shortest distance between head center of gravity and cover member Lc/La (%) | 32 | 32 | 32 | 32 | 18 | 25 | 40 | 50 | 32 |
| Moment of inertia Ic (g · cm$^2$) [larger value is better] | 4400 | 4500 | 5500 | 5600 | 4800 | 4680 | 4600 | 4400 | 4700 |
| Directional stability of hit ball (m) [smaller value is better] | 9.9 | 6.9 | 7.0 | 9.5 | 6.0 | 5.8 | 7.0 | 7.5 | 5.5 |
| Impact feeling [larger value is better] | 3.8 | 3.9 | 3.8 | 3.7 | 3.6 | 3.8 | 3.9 | 3.9 | 4.4 |
| Height of center of gravity (mm) [smaller value is better] | 21.5 | 21.3 | 20.9 | 20.8 | 20.6 | 21.2 | 21.8 | 20.5 | 20.9 |

As a result of the test, it can be seen that the golf club of the embodiment has smaller center of gravity height and larger moment of inertia than the comparison example, and that the directional stability and impact feeling significantly improved. In addition, although experiments were carried out with fiber reinforced resins of different specific gravities and different head volumes, similar results to the tests were obtained.

What is claimed is:

1. A golf club head provided with a hollow comprising a head main portion made of metal material and having at least one opening, a cover member made of fiber reinforced resin and covering the opening, the opening comprising a crown opening region provided in a crown portion and a sole-side opening region provided in a sole portion and a side portion, the crown opening region having an opening area projected onto an outer surface of the club head being in a range of from 63% to 77% of a superficial area of the crown portion, the sole-side opening region having an opening area projected onto the outer surface of the club head being in a range of from 4% to 25% of the superficial area of the sole portion and the side portion in sum total, wherein in a standard state in which the head is disposed on a horizontal plane so that a center line of a club shaft is inclined at the lie angle within a vertical plane and a club face forms its loft angle with respect to the vertical plane, a bottom view of the head has a face-heel region and a back face-heel region, the face-heel region is a region which is located in front and heel side when the bottom view of the head is divided as four regions by a first straight line parallel with the center line of the club shaft and passing through a center of gravity of the head, and a second straight line being at right angle to the first straight line and passing through a center of gravity of the head, the back face-heel region is a region which is located in back and heel side area of the four regions, and the sole-side opening region is disposed in the face-heel region and/or the back face-heel region.

2. The golf club head according to claim 1, wherein the opening is a single opening in which the crown opening region and the sole-side opening region are connected.

3. The golf club head according to claim 1 or 2, wherein a volume of the club head is in a range of from 70 to 500 cm$^3$.

4. The golf club head according to claim 1, wherein a volume of the club head is in a range of from 90 to 220 cm$^3$.

5. The golf club head according to claim 1, wherein the sole-side opening region is disposed in the back face-heel region.

6. The golf club head according to claim 1, wherein ratio Lb/La of the shortest distance Lb in the front-back direction of the head from the leading edge to the crown opening region to a head length La which is maximum length in a front-back direction of the head from a leading edge of the head to the head rear is in a range of from 20% to 45%.

7. The golf club head according to claim 1, wherein in the bottom view of the head, the shortest distance Lc between the position of the center of gravity of the head and the cover member is in a range of from 20% to 45% of a head length La which is maximum length in a front-back direction of the head from a leading edge of the head to the head rear.

8. A golf club comprising a golf club head provided with a hollow, and a club shaft, wherein the golf club head comprises a head main portion made of metal material and having at least one opening, a cover member made of fiber reinforced resin and covering the opening, the opening comprising a crown opening region provided in a crown portion and a sole-side opening region provided in a sole portion and a side portion, the crown opening region having an opening area projected onto an outer surface of the club head being in a range of from 63% to 77% of a superficial area of the crown portion, the sole-side opening region having an opening area projected onto the outer surface of the club head being in a range of from 4% to 25% of the superficial area of the sole portion and the side portion in sum total, wherein in a standard state in which the head is disposed on a horizontal plane so that a center line of a club shaft is inclined at the lie angle within a vertical plane and a club face forms its loft angle with respect to the vertical plane, a bottom view of the head has a face-heel region and a back face-heel region, the face-heel region is a region which is located in front and heel side when the bottom view of the head is divided as four regions by a first straight line parallel with the center line of the club shaft and passing through a center of gravity of the head, and a second straight line being at right angle to the first straight line and passing through a center of gravity of the head, the back face-heel region is a region which is located in back and heel side area of the four regions, and the sole-side opening region is disposed in the face-heel region and/or the back face-heel region.

* * * * *